US006945403B2

(12) United States Patent
Lombardi

(10) Patent No.: US 6,945,403 B2
(45) Date of Patent: Sep. 20, 2005

(54) LOOSE POWDER COMPACT WITH MOVABLE SCREEN

(75) Inventor: Carl Lombardi, Lloyd Harbor, NY (US)

(73) Assignee: Lombardi Design & Manufacturing, Freeport, NY (US)

( * ) Notice: Subject to any disclaimer, the term of this patent is extended or adjusted under 35 U.S.C. 154(b) by 204 days.

(21) Appl. No.: 10/150,780

(22) Filed: May 17, 2002

(65) Prior Publication Data

US 2003/0213723 A1 Nov. 20, 2003

(51) Int. Cl.[7] ..... A45D 33/00

(52) U.S. Cl. ..... 206/581; 132/306; 132/307; 206/823

(58) Field of Search ..... 132/306, 307, 132/298, 301; 206/581, 823, 527, 1.7, 1.8, 1.9

(56) References Cited

U.S. PATENT DOCUMENTS

| | | | | | |
|---|---|---|---|---|---|
| 1,001,771 | A | * | 8/1911 | Roehrig | 132/298 |
| 1,460,864 | A | * | 7/1923 | Root | 132/307 |
| 1,532,830 | A | * | 4/1925 | Marceau | 132/307 |
| 1,590,734 | A | * | 6/1926 | Calnan | 132/299 |
| 1,592,184 | A | * | 7/1926 | Dodson | 132/296 |
| 1,631,588 | A | * | 6/1927 | Greenwald | 132/306 |
| 1,642,780 | A | * | 9/1927 | Kole et al. | 132/295 |
| 1,647,004 | A | * | 10/1927 | Hyde | 132/296 |
| 1,669,017 | A | * | 5/1928 | Poranski | 132/298 |
| 2,055,389 | A | * | 9/1936 | Rosenberg | 132/306 |
| 2,089,833 | A | * | 8/1937 | Kasdan | 132/303 |
| 2,260,764 | A | * | 10/1941 | Anderson | 401/130 |
| 5,107,871 | A | * | 4/1992 | Butcher et al. | 132/304 |
| 5,515,875 | A | * | 5/1996 | Acker et al. | 132/298 |
| 5,603,340 | A | * | 2/1997 | Gueret | 132/293 |
| 6,047,710 | A | * | 4/2000 | Irving et al. | 132/293 |
| 6,053,183 | A | * | 4/2000 | Rizzo | 132/307 |
| 6,129,089 | A | * | 10/2000 | Yuhara | 132/300 |
| 6,173,719 | B1 | * | 1/2001 | Petit | 132/294 |

FOREIGN PATENT DOCUMENTS

| | | | |
|---|---|---|---|
| EP | 0123766 | * | 7/1983 |

* cited by examiner

*Primary Examiner*—Jim Foster
(74) *Attorney, Agent, or Firm*—Bradley N. Ruben

(57) ABSTRACT

A compact for loose powder is provided with a recess in which a screen is movable along the extent of the recess, and is urged to provide the larger space in which the powder is retained. The user pushes the screen, with a brush or puff, to engage the loose powder and to cause the brush or puff to carry the powder for application to a person's skin. The container for the loose powder can be provided as an insert to a screw-type or clamshell-type compact, and/or can be refillable.

18 Claims, 1 Drawing Sheet

LOOSE POWDER COMPACT WITH MOVABLE SCREEN

BACKGROUND OF THE INVENTION

1. Field of the Invention

This invention relates to a container for use as a small cosmetic case, a compact, especially for loose powder.

2. The State of the Art

Cosmetic powder, especially that used for the face, generally comes in a compressed form. Compacts for compressed powder typically have a depression in which the compressed powder is retained. The powder is applied by using a pad or puff, or a brush, which is rubbed over the powder surface to cause the powder to contact and be held by the puff, and then applied from the puff to the face. Compressed powder is usually provided in a clamshell type compact having a bottom portion containing the powder and a top portion that flips open and has a mirror to facilitate application of the powder to the face.

Loose cosmetic powder is now more widely available to the general public and has better coverage qualities and interacts better with make-up. However, because the powder is loose, it must be specially contained. Typically, a loose powder compact has a puff or brush and a dispenser with a mulitiplicity of holes, similar to a talcum powder dispenser. The powder is shaken out of the holes onto the puff, or into a cover or dish from which it is picked up by a brush or puff.

It would be desirable to have a loose powder compact that is more like a conventional compressed powder compact. Also, for dispensers like talcum powder dispensers, excess powder not used usually cannot be put back into the container.

SUMMARY OF THE INVENTION

Among the objects of this invention are to provide a convenient device for storing and dispensing loose cosmetic powder, to avoid the user having to dispense powder that goes unused and must be discarded, and to provide a loose powder compact that can be refilled.

The present invention provides a loose powder container having a bottom wall, a side wall, and a screen provided as a top wall.

In one embodiment, the screen is movable vertically within the compact, and most preferably is elastically biased to return to a given position.

In another embodiment, the container is provided as an insert that can be placed in a compact analogous to a conventional compressed powder compact.

In yet another embodiment, the container has a removable bottom so that the container can be refilled with powder.

DETAILED DESCRIPTION OF SPECIFIC EMBODIMENTS

Figure 1:
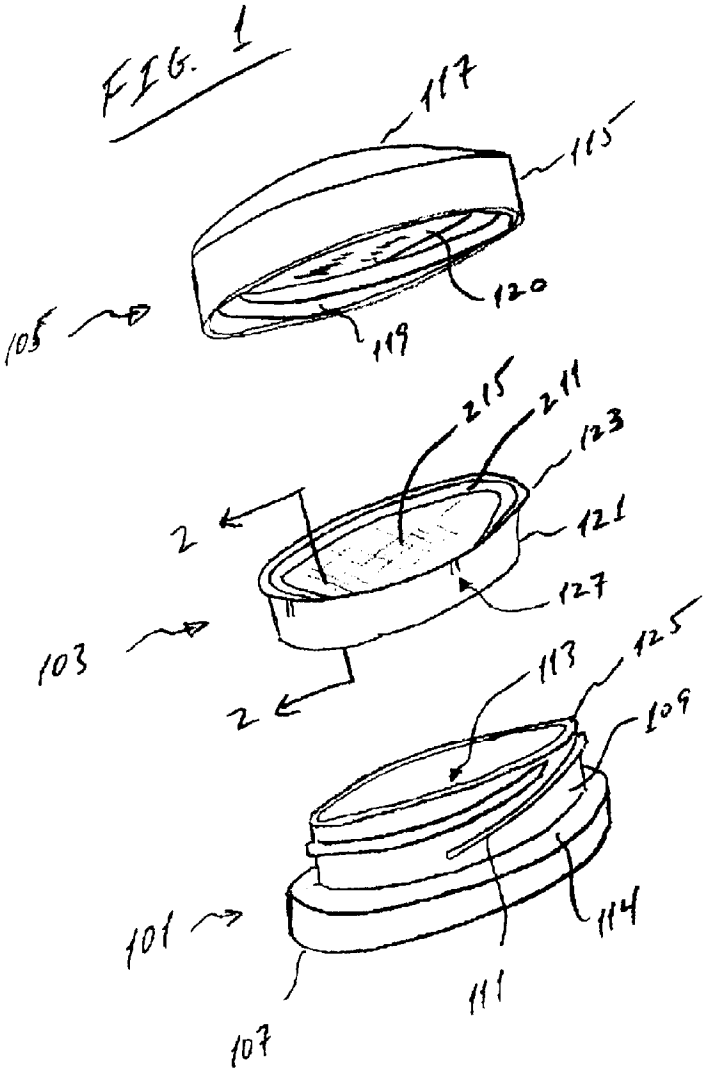
FIG. 1 is a partially-exploded perspective view of a compact having the loose powder container of the present invention.

FIG. 1 depicts a partially-exploded perspective view of a compact utilitizing one version of the loose powder container of the present invention. The compact has a bottom portion 101, a loose powder container 103, and a top 105. The bottom includes a base 107 from which is an upstanding cylindrical wall 109 having along its outer wall threads 111 to allow the top and bottom to engage by being screwing together. The cylindrical wall defines a recess 113 that may extend down into the base below the step 114 formed by the intersection of the base and the outside of cylindrical wall containing the threads. The top includes a depending side wall 115 and a dome 117. The interior portion of the side wall has grooves 119 corresponding to and engageable with the threads in the bottom to allow the top and the bottom to engage and disengage by screwing together and apart. The inner portion of the dome can house a mirror 120. Preferably, when the top and bottom are engaged, there is sufficient clearance between the top of the loose powder container and the inside of the dome to house a puff (not shown).

The loose powder container also has a side wall 121 having a lip 123 at one circumferential extent. The lip engages the top face 125 of the cylindrical wall of the bottom portion. To facilitate a friction fit between the loose powder container and the bottom, a number of friction bars 127 extend normal from the side wall and frictionally engage the inner cylindrical wall forming the recess of the bottom portion.

Figure 3:
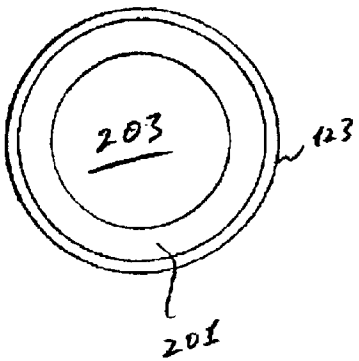
FIG. 3 is a bottom view of the loose powder container.
Figure 2:
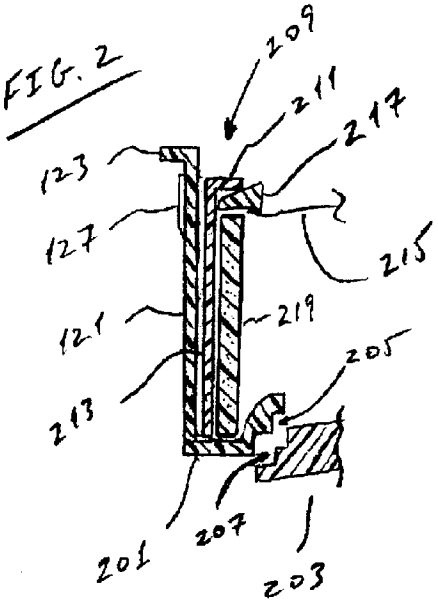
FIG. 2 is a cross-sectional view of the loose powder container taken along line 2—2 in FIG. 1.

FIG. 2 is a partial cross-sectional view through the loose powder container along line 2—2 of FIG. 1. The side wall 121 terminates in an annular base wall 201. The other end of the base wall is continous, or more preferably terminates in a means for frictionally engaging a bottom cover 203. In the embodiment shown, the bottom cover and the base wall have a series of steps 205, 207 that are of a tolerance that allows for the bottom cover to snap into the base wall, as shown in FIG. 3. In use, the bottom cover can be removed to provide an opening for refilling the container with loose powder.

Disposed interiorly of the cylindrical wall 121 is a securing ring 209 having a rim 211 and a depending ring wall 213. The securing ring secures a screen 215 having a flange 217 around its periphery. The screen is supported distant from the base wall by a flexible, elastic material 219, preferably a foam material. Thus, in summary, the loose powder container has a wall around its periphery, inside of which is a securing device that holds the screen, and the screen is supported against the securing device by an elastic material. The loose powder is housed between the screen and the base wall or, if removable, the base cover.

The elastic material allows the screen to be depressed to reach the powder. That is, as powder is used, a space develops between the screen and the top of the powder surface. The user uses the puff to press down on the screen until the screen engages the powder. The screen is sized so that powder can pass through the holes in the screen, but the holes are not so large that powder easily flows out. The powder is generally sealed in by the puff, although a separate, replaceable seal could be used. When the screen is depressed with the puff (or a brush) to engage the powder, the powder passes through the holes in the screen and is deposited on the puff for use. When the user lifts the puff from the screen, the elastic material causes the screen to move towards and engage the rim of the securing ring.

The top, bottom, and container (or top and container) are preferably made of reasonably durable plastic, such as polycarbonate or polypropylene, although one or more parts can be made of metal, or metallized plastic. The parts can even be made of wood or another degradable material. The screen is preferably made of plastic, preferably comprised of nylon (or another polyamine), polypropylene (or another polyalkykene), or any suitable polymer that maintains its dimensional integrity and does not react (physically or chemically) with the powder. The size of the screen hole is about is about 170 microns across using fibers having a diameter (or cross-section) of about 62 microns. The screen could also be made of metal, such as brass or aluminum or stainless steel wire; again, of a material that does not react with the powder. The screen is secured to the flange by conventional means, such as gluing or ultrasonic welding. The foam is preferably a polyolefin or polyurethane foam having a density of about 1.75±0.5 pounds per cubic foot (PCF) and more preferably ±0.1 PCF, an indentation force deflection (IFD; on four inch thickness at 25% deflection) of 90±12 and more preferably ±6, a resilience of at least 25% and more preferably at least 35%, a tensile strength of at least 8 psi and more preferably at least 17 psi, an elongation of at least 90% and preferably at least 120%, a tear strength of at least about 1.5 pounds per inch and more preferably at least about 2.0 pounds per inch, and a 90% compression set of at least 10% and more preferably at least 15%. These standards are generally based on ASTM D-3574-86 and are standards used by such organizations as the Polyurethane Foam Association (Knoxville, Tenn., www.pfa.org). While these are preferred specifications for the foam, it should be understood that other foams and structures could be used, including, even, a thin-wired large diameter spring (preferably made of plastic or a metal non-reactive with the powder or moisture).

While the invention has been described in respect of the foregoing embodiments, various changes can be made without departing from the scope and spirit of the invention. For example, the base cover can be eliminated. Similarly, the loose powder container need not be a separate element: the securing ring and screen/flange can be sized to fit directly into the recess in the bottom portion. The compact need not be circular, but can be oval or even rectilinear (e.g., square or octagonal). Also, for example, a typical clamshell compact configuration with a hinged top can be used as an alternative way of attaching the top and bottom.

The foregoing description is meant to be illustrative and not limiting. Various changes, modifications, and additions may become apparent to the skilled artisan upon a perusal of this specification, and such are meant to be within the scope and spirit of the invention as defined by the claims.

What is claimed is:

1. A container for loose cosmetic powder, comprising: a container having a bottom wall and an upstanding side wall defining a first recess and a periphery thereof; a securing ring having a rim coextensive with the periphery and defining an opening and also having a depending ring wall disposed within the first recess and defining a second recess; a flexible screen mounted on a flange and disposed in the second recess, accessible through the opening, moveable with the flange to traverse the ring wall within the second recess, and retained in the second recess by the rim; and elastic means for biasing the screen into normally abutting relationship with the rim and for permitting the screen and flange to traverse the side wall towards the bottom wall, the elastic biasing means spanning between the bottom wall and the rim, the flange being disposed between the rim and the elastic biasing means.

2. The container of claim 1, wherein said elastic means is a flexible member supporting the screen distant from the bottom wall, disposed in the second recess along the ring wall, and permitting movement of the screen between the rim and the bottom wall.

3. The container of claim 1, wherein the elastic means comprises foam.

4. The container of claim 1, further comprising in combination a top portion and a bottom portion releasably engageable with each other, the bottom portion having a third recess adapted to receive said container for loose powder, the combination of top portion, bottom portion, and container providing a compact.

5. The compact of claim 4, wherein the top portion contains a mirror.

6. The container of claim 1, wherein the container includes a removable base cover.

7. The container of claim 1, further comprising a top portion, and means for releasably engaging the top portion with the container.

8. The compact of claim 4, wherein said elastic means comprises foam.

9. The compact of claim 4, further comprising in said container loose cosmetic powder.

10. The compact of claim 5, further comprising in said container loose cosmetic powder.

11. The container of claim 6, further comprising in said container loose cosmetic powder.

12. The container of claim 7, wherein said urging means comprises foam.

13. The container of claim 12, further comprising in said container loose cosmetic powder.

14. The compact of claim 4, wherein the container further comprises a removable base cover.

15. The container of claim 1, further comprising in said container loose cosmetic powder.

16. The container of claim 1, wherein the elastic means is a spring.

17. The container of claim 15, wherein the container includes a removable base cover.

18. The container of claim 17, further comprising combination a top portion and a bottom portion releasably engageable with each other, the bottom portion having a third recess adapted in which to receive said container for loose powder, the combination of top portion, bottom portion, and container providing a compact.

* * * * *